US005960985A

United States Patent [19]

Barrett

[11] Patent Number: 5,960,985

[45] Date of Patent: Oct. 5, 1999

[54] CONTAINER LID AND CONTAINER

[76] Inventor: Robert K. Barrett, 2190 Pineneedle Row, Mississauga, Ontario, Canada, L5C 1V3

[21] Appl. No.: 08/942,010

[22] Filed: Oct. 1, 1997

[30] Foreign Application Priority Data

Oct. 3, 1996 [CA] Canada ..... 2187048

[51] Int. Cl.[6] ..... B65D 41/16

[52] U.S. Cl. ..... 220/780; 220/796; 206/508

[58] Field of Search ..... 220/780, 781, 220/796, 521, FOR 100, FOR 105; 206/508

[56] References Cited

U.S. PATENT DOCUMENTS 2,614,727 10/1952 Robinson .
2,711,840 6/1955 Gits et al. .
3,070,275 12/1962 Bostrom .
3,269,588 8/1966 Ruekberg .
3,335,901 8/1967 Edwards .
3,373,896 3/1968 Davis .
3,424,342 1/1969 Scopp et al. .
4,360,119 11/1982 Olivo .
4,407,426 10/1983 McLaren et al. .
4,886,184 12/1989 Chamourian .
5,725,122 3/1998 Murphy et al. .
5,810,190 9/1998 Welch .

*Primary Examiner*—Stephen K. Cronin
*Assistant Examiner*—Robin A. Hylton

[57] ABSTRACT

A container lid for a container, the lid having a wall to fit around an upper end of the container, a sealing ridge or retention ridge within the wall to interengage with the upper end of the container, a stop shoulder within the lid, to abut against the top edge of the container, an upstanding inverted channel extending inwardly from the shoulder, and extending upwardly there from, and a downwardly dependent inner wall extending from the channel, a transverse junction wall extending from the lower end of the inner wall, a generally vertical wall extending downwardly from the transverse wall, and a closure panel extending across the closure, from the downwardly dependent wall, and, a label retention lip formed integrally with the container lid and extending at a generally inward angle from the conjunction between the inner wall and the downwardly dependent wall, in which a label may be inserted and in which the lip defines a predetermined spacing from the upper surface of the ridge, so as to protect the lip, and a container having a lid with the foregoing features.

10 Claims, 2 Drawing Sheets

CONTAINER LID AND CONTAINER

FIELD OF THE INVENTION

The invention relates to container lids, and in particular, to a container lid, manufactured out of rigid plastics materials, which lid incorporates a label retaining lip, and to a container having such a lid.

BACKGROUND OF THE INVENTION

In the manufacture of containers, it is common practise to provide a snap on lid with a central flattened area. A label may be printed directly on the flattened area or a label may be applied and glued in place. When using such containers with certain frozen food products particularly ice cream, it is desirable that the lids shall not be preprinted, but shall be labelled prior to or after the container has been filled. Gluing materials used for labels may be hot melt type materials, heat activated or pressure sensitive in order to obtain a fast bond of the label. There are disadvantages when using adhesives. Glued-on labels can distort due to uneven thermal shrinkage between the lid and label, from the time the label is applied and glued to the time the product has frozen.

Accordingly, it is becoming the practice to provide labels for such products which are not glued or bonded in place, but are held in place by some portion of the lid itself. This requires a lid which is formed with a specially adapted flexible label retention lip. The label is usually printed on card stock, and must be snap fitted inside this lip. The lip terminates in a thin flexible edge, which extends inwardly and encloses the edge portion of the label. This practice overcomes the problem created by hot melt, heat activated or pressure sensitive adhesives for label retention. However, when such filled containers are stacked for shipping, or when they may be stacked on shelves in a store, the containers will usually be stacked one on top of the other. In some cases the lower end of the container will fit within the label retaining lip. In other cases the container has perpendicular sides, and the base of one container rests on the lid of the next.

In other cases, it is the practice to stack filled containers, for shipping purposes, alternately the right way up and upside down. Since the containers are sometimes tapered, this saves space for shipping, and also provides a more secure package on a pallet or the like.

In these cases, where alternate containers are stacked upside down, the weight of the container and the product it contains is carried on the label retention lip. This tends to damage the label retention lip and impairs the appearance and appeal of the product. It may also lead to the label becoming dislodged.

For all of these reasons, it is desirable to provide a lid having a label retention lip which is recessed within the lid and is protected against damage during storage or shipping.

BRIEF SUMMARY OF THE INVENTION

With a view to overcoming the various disadvantages and problems described above, the invention comprises a container lid for a container, the lid having a wall adapted to fit around an upper end of the container, a sealing ridge within said upper wall adapted to inter-engage with a sealing lip on the upper end of the container, a stop shoulder within said lid adapted to abut against the top edge of the container, an upstanding inverted channel formation extending inwardly from said shoulder, and extending upwardly therefrom, and providing a rigid load bearing surface, and a downwardly dependent inner wall extending from said channel said inner wall forming a generally angled shape, a transverse junction wall extending from the lower end of said the inner wall, a generally vertical wall extending downwardly from said transverse wall, and a closure panel extending entirely across said closure, from said downwardly dependent wall, and, a label retention lip formed integrally with said container lid and extending at a general inward angle from the conjunction between said inner wall and said downwardly dependent wall, whereby a label may be inserted within said lip, and may lie upon said closure, and wherein said lip defines a predetermined spacing from the upper surface of said ridge, whereby to protect said lip.

Another feature of the invention provides that the sealing ridge is located spaced downwardly from the shoulder, and registering more or less with the planar wall of the closure.

Another feature of the invention is the provision of a ledge portion between the wall and the outer side of the inverted channel.

The invention also provides a container having such a lid as described.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
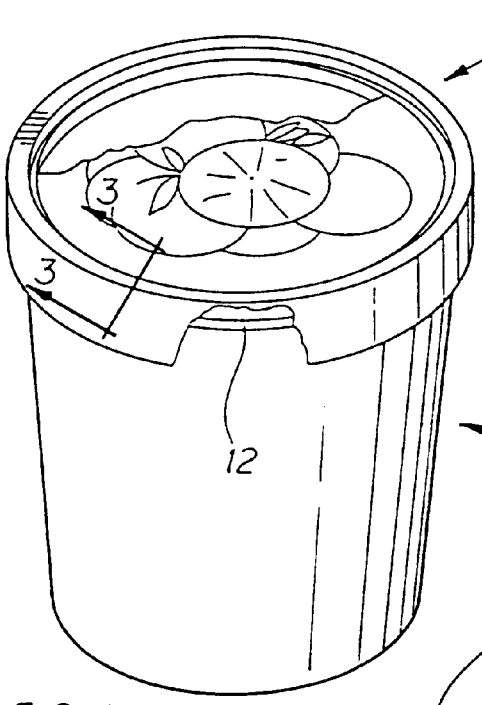
FIG. 1 is a perspective of a container of the type to which the invention relates showing a container lid partially cut away illustrating the various features of the invention.

Referring first of all to FIG. 1, it will be seen that this illustrates a typical container indicated generally as 10. Such a container is usually injection moulded or thermoformed out of a suitable plastic material, or formed out of paper or composite material and may be used to contain any food product, typically ice cream. The container 10 in this illustration is usually formed at its top with an enlarged rim 12. A lid 14 is provided to provide a hygienic closure for the container both during shipping and when displayed for sale and also when used in the home for example.

While the container 10 illustrated in FIG. 1 is of generally frusto-conical shape, other containers of a variety of shapes, such as square, rectangular, oval or the like may also usefully incorporate lids according to the invention. Any materials may be used whether plastic, paper or other material of which containers can be made.

Figure 2:
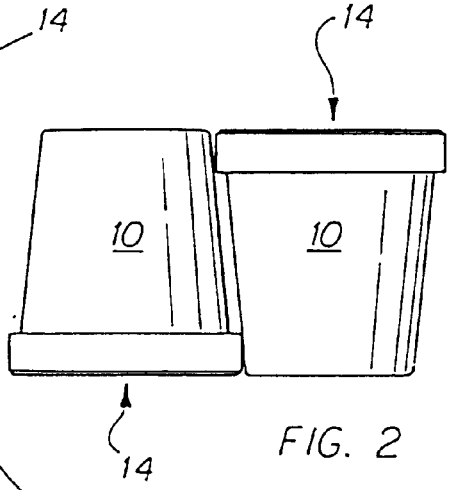
FIG. 2 is a schematic view of the stacking arrangement of multiple tapered containers reversed alternately upside down.

As shown in FIG. 2, such containers may be stacked alternately upside down, to save space for shipping and storage, and to provide a more stable package when bundled together.

Figure 3:
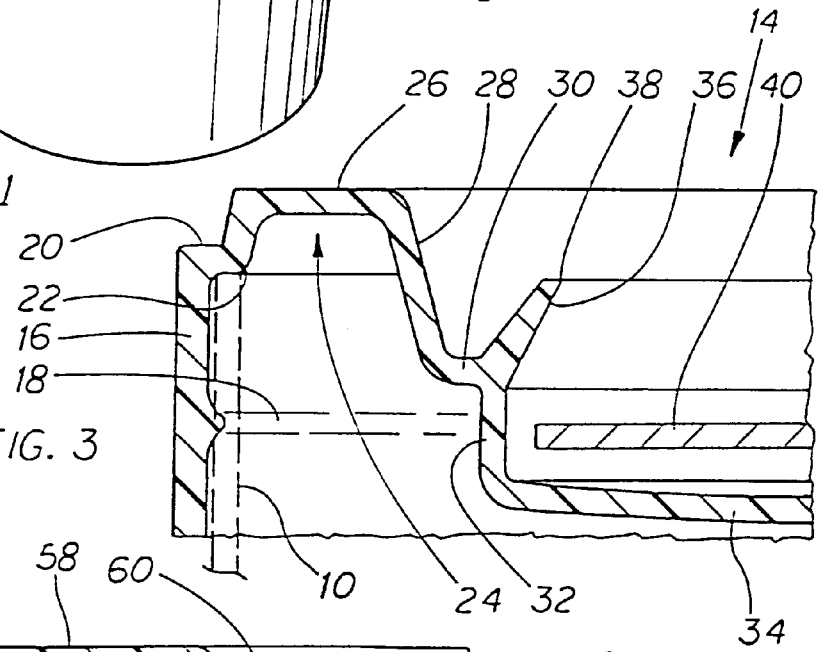
FIG. 3 is an enlarged partial side elevation, in section, along the line 3—3 of FIG. 1, showing the profile of the container lid in more detail.

Referring now to FIG. 3 the lid 14, which is formed of plastic material comprises side wall 16, which may be cylindrical, square, rectangular or oval in shape depending on the shape of the container, to fit snugly around the container 10. The side wall 16 is formed with an inwardly extending sealing retention ridge 18, between its lower and upper extremities. Around the top edge of outside of the wall 16, there is formed a generally right angular ledge 20 on the exterior and on the interior there is a corresponding radiussed interior stop shoulder 22.

Formed integrally with and extending inwardly with respect to shoulder 22, is an inverted channel formation 24, having a generally planar upwardly directed channel web 26. Channel 24 is formed with an inner wall 28 which is inwardly angled and extends downwardly within but spaced from wall 16.

A short transverse junction wall 30 is formed integrally with angled wall 28, and meets substantially at a right angle with a downwardly dependent inner wall 32.

Inner wall 32 is formed integrally with a closure panel 34, which extends across the container lid.

Substantially at the junction between the transverse wall 30 and the vertical wall 32, there is formed an inwardly angled label retaining lip 36. Lip 36 is of generally tapering shape being wider at its junction with walls 30 and 32 and narrower at its extremity, and defines an inwardly directed sharp or radiussed corner 38.

It will be noted that the upper extremity of the lip 36 is spaced below the planar bearing surface 26 of the inverted channel 24 for reasons to be described.

The lip 36 permits the insertion of a label panel 40. Panel 40 will usually be a panel card stock, printed on one or both sides with information concerning the product. It is simply inserted by flexing the panel, so that it snaps inside the lip 36 and is retained loosely in position. This retention of the label solves problems created previously by the use of hot melt glues, pressure sensitive materials and like adhesives that fix the label panel to the closure panel.

The fact that the extremity of the lip 36 is located below the level of the load bearing surface 26 of the channel 24 ensures that when the containers are stacked upright or inverted the weight of the container is carried on the load bearing surface 26, and the lip 36 is not carrying any load.

The stop shoulder 22 serves to abut against the upper edge of the container, and to prevent the container from entering any further into the lid. This ensures that there is a direct load bearing relation between the channel 56, and the upper edge of the container.

Figure 4:
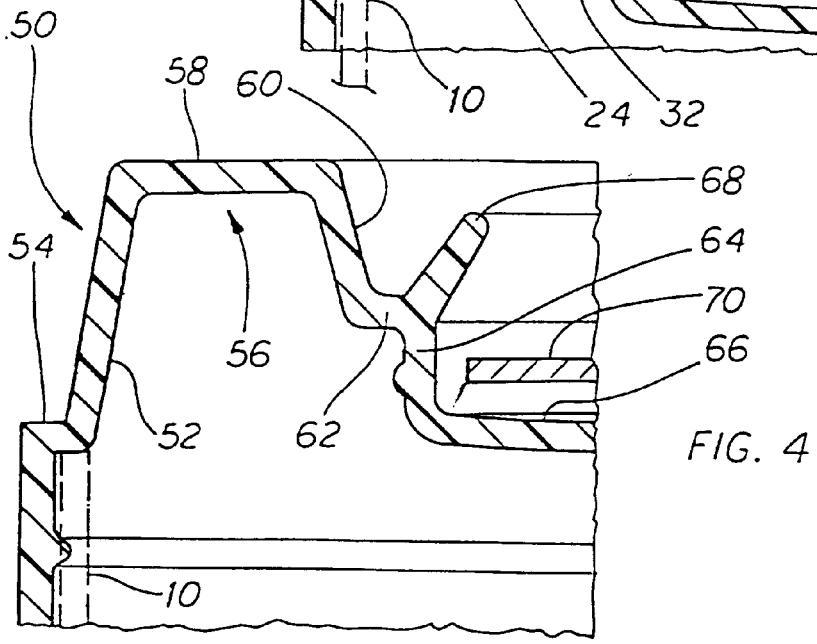
FIG. 4 is a view of an alternate embodiment.

FIG. 4 shows another embodiment of a lid illustrating the invention. The lid 50 comprises a side wall 52 and a sealing ridge (not shown). A ledge 54 extends inwardly at the top of wall 52 and an upwardly directed inverted channel 56 defines a planar channel web 58. The inner wall 60 of the channel extends to meet junction wall 62. Wall 62 in turn merges with cylindrical wall 64, which supports closure panel 66.

A label retaining flange 68 is formed at an angle at the junction between wall 62 and wall 64, and extends inwardly in a frusto-conical manner to retain a label panel 70 therein.

Figure 5:
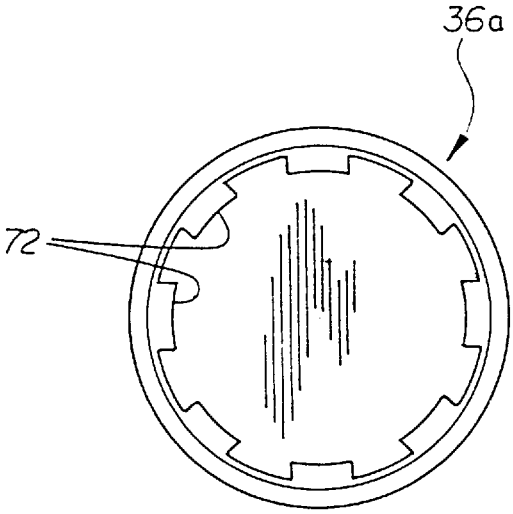
FIG. 5 shows a further alternate embodiment.

FIG. 5 shows a further embodiment in which the label retaining lip 36A is formed in the shape of rectangular castellations 72 to give greater flexibility if required.

Figure 6:
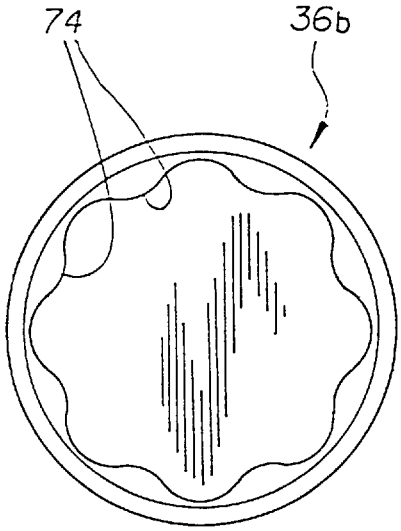
FIG. 6 shows a further alternate embodiment.

FIG. 6 shows another form of the FIG. 5 embodiment with the lip 36B having serrations 74 of sine wave shape.

Figure 7:
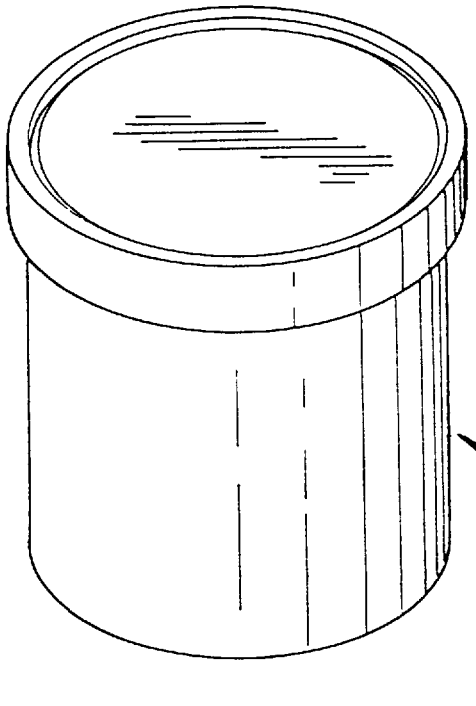
FIG. 7 shows a further alternate embodiment.

FIG. 7 illustrates the use of a lid in accordance with the invention, on a container of cylindrical shape.

Containers according to the invention show improved stacking properties. The containers may be stacked in an interlocking pattern. This also puts a load on the surface of the lid.

Figure 8:
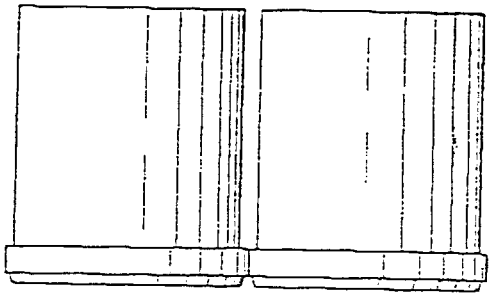
FIG. 8 shows an alternate arrangement for stacking containers.

FIG. 8 illustrates the stacking containers which are all upside down, so as to maintain the contents in contact with the lid.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A container lid for a container, the lid comprising:

an outer wall adapted to fit around an upper end of a container;

a stop shoulder extending radially inwardly from said container wall within said lid, adapted to abut against top edge of a container;

an upstanding inverted channel formation extending inwardly from said shoulder, and extending upwardly therefrom, and providing a rigid load bearing channel surface, and including a downwardly dependent inner wall forming an angled shape in section;

a transverse junction wall extending from the lower end of said inner wall;

a vertical wall extending downwardly from said transverse wall;

a closure panel extending across said closure from said vertical wall; and a label retention lip formed integrally with said container lid and extending at an inward angle from the junction of said transverse wall and said vertical wall in which a label is insertable within said lip and lies upon said closure panel, and wherein said lip defines a predetermined spacing from said load bearing surface of said channel, to protect said lip.

2. A container lid as claimed in claim 1 including a sealing ridge in the lid spaced downwardly from the stop shoulder and registering substantially with the outer wall of the closure.

3. A container lid as claimed in claim 1 including a ledge portion between the outer wall and the outer side of the inverted channel.

4. A container lid for a container as claimed in claim 1, and wherein said stop shoulder is at an upper end of said lid wall, lying in a plane located spaced above the plane of said closure panel.

5. A container lid as claimed in claim 4 and wherein said stop shoulder is formed within said lid wall, and lies in a plane substantially co-planar with said closure panel.

6. In combination, a container lid as claimed in claim 1 fitted on a container of tapered shape.

7. In combination a container lid as claimed in claim 1 fitted on a container of cylindrical shape.

8. A container lid for a container having an open upper end, the lid comprising:

an outer wall adapted to fit around an upper end of a container;

a stop shoulder extending radially inwardly from said container wall within said lid, adapted to abut against a top edge of a container, said stop shoulder being located at an upper end of said lid outer wall, lying in a plane spaced above the plane of said closure panel, and said stop shoulder being formed within said lid outer wall, and lying in a plane substantially coplanar with said closure panel;

a sealing ridge in the lid spaced downwardly from the stop shoulder, and registering substantially with the outer wall of the closure;

an upstanding inverted channel formation extending inwardly from said shoulder, and extending upwardly therefrom, and providing a rigid load bearing channel surface, including a downwardly dependent inner wall forming an angled shape in section;

a ledge portion between the outer wall and the outer side of the inverted channel;

a transverse junction wall extending from the lower end of said inner wall;

a vertical wall extending downwardly from said transverse wall;

a closure panel extending across said closure from said vertical wall; and a label retention lip formed integrally with said container lid and extending at an inward angle from the junction of said transverse wall and said vertical wall, in which a label is insertable within said lip and lies upon said closure panel, and wherein said lip defines a predetermined spacing from said load bearing surface of said channel to protect said lip.

9. A container with a re-sealable lid comprising:

a container having a side wall, a bottom wall, and an open top;

a lid having an outer wall fitting around an upper end of the container;

a stop shoulder extending radially inwardly from said container wall within said lid to abut against a top edge of said container, said stop shoulder being located at an upper end of said lid outer wall, lying in a plane spaced above the plane of said closure panel, and said stop shoulder being formed within said lid wall and lying in a plane substantially coplanar with said closure panel;

a sealing ridge in the lid spaced downwardly from the stop shoulder, and registering substantially with the outer wall of the closure;

an upstanding inverted channel formation extending inwardly from said shoulder, and extending upwardly there from, and providing a rigid load bearing channel surface, including a downwardly dependent inner wall forming an angled shape in section;

a ledge portion between the outer wall and the outer side of the inverted channel;

a transverse junction wall extending from the lower end of said inner wall;

a vertical wall extending downwardly from said transverse wall;

a closure panel extending across said closure from said vertical wall; and a label retention lip formed integrally with said container lid and extending at an inward angle from the junction between said transverse wall and said vertical wall, in which a label is insertable within said lip and lies upon said closure panel, and wherein said lip defines a predetermined spacing from said load bearing surface of said channel to protect said lip.

10. A container as claimed in claim 9 wherein said bottom wall of said container has predetermined dimensions, and wherein said channel formation is dimensioned to register with said bottom wall of said container and support the bottom wall of said container clear of a label retained by said lip.

* * * * *